United States Patent [19]

Rothkegel et al.

[11] 4,153,755

[45] May 8, 1979

[54] IMPREGNATED SINTERED MATERIAL FOR ELECTRICAL CONTACTS AND METHOD FOR ITS PRODUCTION

[75] Inventors: Bernhard Rothkegel; Horst Schreiner, both of Nüremberg, Fed. Rep. of Germany

[73] Assignee: Siemens Aktiengesellschaft, Munich, Fed. Rep. of Germany

[21] Appl. No.: 880,340

[22] Filed: Feb. 23, 1978

[30] Foreign Application Priority Data

Mar. 3, 1977 [DE] Fed. Rep. of Germany ..... 2709278

[51] Int. Cl.[2] ..... B22F 3/00

[52] U.S. Cl. ..... 428/569; 75/200; 200/264

[58] Field of Search ..... 200/264; 428/569; 75/200.1

[56] References Cited

U.S. PATENT DOCUMENTS

| | | | |
|---|---|---|---|
| 2,289,708 | 7/1942 | Jackson | 200/264 |
| 3,489,530 | 1/1970 | Schreiner | 428/569 |
| 3,610,859 | 10/1971 | Schreiner | 200/264 |
| 3,821,505 | 6/1974 | Wood | 200/264 |

*Primary Examiner*—Brooks H. Hunt

*Attorney, Agent, or Firm*—Kenyon & Kenyon, Reilly, Carr & Chapin

[57] ABSTRACT

An impregnated sintered material for making electrical contact members which have a low fusing force and little burning in which a powder mixture of W, Ag and/or Cu, a wetting promoting metal, and 2 to 5 percent by weight graphite is granulated thermically, and another 1 to 6 percent by weight graphite admixed to the granules, after which the mixture is compacted to form a skeleton and impregnated with Ag and/or Cu. The carbon contained in the finished material is partly in bound form as WC and partly free carbon in a 1:5 to 5:1 ratio.

3 Claims, No Drawings

IMPREGNATED SINTERED MATERIAL FOR ELECTRICAL CONTACTS AND METHOD FOR ITS PRODUCTION

BACKGROUND OF THE INVENTION

The invention relates to an impregnated sintered material for electrical contact members, consisting of a silver and/or copper filled skelton of tungsten, silver and/or copper, and an additive of a wetting promoting metal such as iron, nickel, cobalt, and to a method for its production.

Because of its high thermal and electric conductivity silver is a preferred material for contact members. However, in an arc such as those originating from the breaking and making of contacts, the silver located in the contact area of such contact members evaporates and spatters easily. This leads to high material wear (burning). Moreover, particularly when chatter occurs in contact making, silver contact members tend to freeze and fuse readily so that they can be reseparated from each other only by using force (known as the fusing force). Therefore, particularly in low voltage switch gear, contact members which contain graphite particles embedded in the silver, whereby the fusing force is reduced considerably, are usually used. Such contact members also have only a slight electrical contact resistance. Since graphite is not wettable by liquid silver, such contact members are usually produced by pressing and sintering a mixture of silver and graphite powders at temperatures below the melting point of silver. The porosity of sintered materials produced in this manner is high, usually at least 5 to 7 percent by volume, and their mechanical stability is poor. Furthermore, their thermal and electrical conductivity is reduced due to the embedded graphite. As a result, the burn-off losses of such sintered materials are high. This applies also to sintered materials consisting of copper with embedded graphite.

Compared to silver and copper, the mechanical hardness and burning resistance of tungsten is greater. Therefore, when tungsten powder is compacted and subsequently impregnated with liquid silver or copper at temperatures above their melting points, an impregnated material consisting of a tungsten skeleton which is filled with silver or copper is obtained. Since tungsten is wetted poorly by silver, it is advantageous to admix small amounts of iron, nickel, or cobalt to the silver, whereby the solubility of tungsten in the molten silver and its wettability are improved. Compared to tungsten, tungsten carbide, which forms from a mixture of tungsten and graphite powders at high temperatures, has an even greater hardness and burning resistance. According to H. Schreiner, "Pulvermetallurgie elektrischer Kontakte" (Powder Metallurgy of electrical contacts), Berlin/Gottingen/Heidelberg, 1964, ages 148/9, an impregnated sintered material can be produced by first producing a sintered skeleton of a powder containing tungsten, copper or silver, and nickel, and subsequently impregnating this skeleton. Such a material contains practically no pores, and its hardness, burning resistance and conductivity are improved. But, these advantages are obtained at the expense of a greater fusing force and of a usually higher electrical resistance.

SUMMARY OF THE INVENTION

It is an object of the present invention to make available a new material for electrical contacts whose fusing force is lower with, at the same time, a lower burning loss and greater mechanical stability.

According to the present invention, this problem is solved by using an impregnated sintered material of the type described at the outset which has a carbon content of 2.0 to 7.0 percent by weight. The carbon is present partly in bound form as tungsten carbide and partly in free form as graphite particles embedded in silver. The ratio of bound to free carbon is at least 1:5 and at most 5:1.

To produce a material containing tungsten, silver or copper, and graphite by a sintering method, the methods incorporating hot compacting or sintering under pressure of appropriate powder mixtures could be resorted to. In such methods, however, the graphite quickly converts to carbide. In addition, even under high pressures, a bothersome residual porosity remains as soon as it is attempted to produce a material with significant graphite content. For, a graphite content of 4 percent by weight, for instance, already corresponds to about 18 percent by volume, and, due to the poor wettability of graphite by molten metals, the stability of such a sintered material is inadequate. Moreover, the wettability of tungsten carbide, like graphite, by liquid silver or copper is very poor. While impregnated materials containing tungsten carbide, but free of graphite, can be produced by adding wetting promoting additives, an impregnating method, too, seems unsuited for the production of a material in which graphite particles are embedded in silver or copper.

Off hand, these difficulties should lead a specialist away from suggesting a material for electrical contact members which contains tungsten, silver and/or copper, and graphite. Beyond this, tests have shown that even a method in which silver and/or copper are already admixed to the tungsten/graphite powder mix to produce the skeleton and in which the skeleton is subsequently produced by pressing and/or sintering and impregnated with molten Ag or Cu only leads to a porous part having high burning losses under arcing. Even when the skeleton is produced at temperatures above the melting point of silver, the only thing achieved is that the graphite is then more or less completely converted to carbide, without the possibility of obtaining a material with a significant content of free graphite. In view of the poor wettability of carbide and the unwettability of graphite, the pores forming during the compaction of the skeleton are obviously not suited for absorbing the impregnating metal to a large extent.

However, for the production of the impregnated sintered material according to the present invention, a method in which an intimate powder mixture of tungsten, a part of the total amount of silver and/or copper to be used, the wetting promoting metal, and also only a part of the graphite to be used is produced first and thermically granulated in a protective gas atmosphere at temperatures between 800° and 1100° C. is suitable. Subsequently the rest of the graphite to be used is admixed to the granules, the mixture is compacted to a skeleton, and the skeleton is sintered and impregnated with the rest of the silver and/or copper. The powder mixture contains 2 to 5 percent by weight graphite, and another 1 to 6 percent by weight graphite powder relative to the powder mixture is added to the granules prior to the compaction.

The powder mixture may advantageously contain a total of about 10 to 45 percent by weight silver and/or copper and 0.1 to 2 percent by weight iron, cobalt and- /or nickel. The tungsten content is preferably dosed so that it amounts to 25 to 70 percent by volume, in particular 30 to 60 percent by volume, in the finished material. The tungsten content is given in volumetric percentages because the graphite percentages depend, for instance, on the different specific gravities of Cu and Ag.

The impregnated sintered material may advantageously be produced, for instance, so that the powder mixture is sintered under a pressure between 50 and 200 $MN/m^2$ in a hydrogen atmosphere for about 10 to 60 minutes. The sintering time may be selected shorter, the higher the sintering temperature. The sintered parts are subsequently crushed and brought to a particle size between 0.2 and 0.4 mm, for instance. The additional graphite is admixed to the particles produced by this "thermal granulation." The compaction then follows under pressures between 100 and 500 $MN/m^2$, and the pressed part obtained is impregnated with the rest of the silver and/or copper, for instance at temperaatures between 1100° and 1250° C. in a hydrogen atmosphere.

A considerable part of the graphite is transformed into tungsten carbide during the thermal granulation. The tungsten carbide surrounds the tungsten particles like cups. The tungsten particles sintered together are possibly broken apart internally in the subsequent crushing operation so that new fracture surfaces free of carabide are created. This allows wetting these newly formed fractures with the impregnation metal during the impregnation. In so doing, another part of the graphite is converted to carbide so that the ratio of bound carbon to free carbon in the finished material is between 1:5 and 5:1.

The fusing force of contact members consisting of this impregnated sintered material is not nearly as strong as that of an impregnated material consisting of graphiteless tungsten carbide and silver, and has a fusing force of the order of magnitude of the fusing force of a sintered material consisting of silver with embedded graphite. But, the burning loss is considerably less than in a corresponding sintered material. It is further of advantage that this impregnated sintered material has a low contact resistance. The reason may be that a part of the graphite on the surface sublimes in the arc, forming a reducing atmosphere which counteracts the formation of oxide films. Another significant advantage is that the impregnated sintered material has great mechanical stability even at high temperatures and under heavy loads. The electrical and thermal conductivity is better than that achievable with sintered silver/graphite materials, a fact attributable to the smaller residual porosity of the material still present. As a polished section demonstrates, the porosity is less than 5 percent by volume. The material can also be produced with a porosity below 3 percent by volume. The ratio of free carbon (graphite) to bound carbon (carbide) is preferably between 0.3:1 and 3:1.

DETAILED DESCRIPTION OF THE INVENTION

The invention will now be explained in even greater detail by way of examples.

EXAMPLE I

First, a powder mixture of 59 percent by weight tungsten powder, obtained by the reduction of $WO_3$ and having a particle size smaller than 0.06 mm, 36 percent by weight electrolytic silver powder of a particle size smaller than 0.037 mm, and 1 percent by weight carbonyl iron powder of a particle size smaller than 0.037 mm is produced and mixed intimately. Then plates are made under a pressure of 100 $MN/m^2$ and sintered in a hydrogen atmosphere at 100° C. for 15 minutes. After cooling, the plates are coarse crushed with a jaw-type crusher and brought to a particle size smaller than 0.037 mm in a face gear mill. Another 4 percent by weight graphite is admixed to the granules thus formed.

The granule/graphite mixture is prepressed under a pressure of 100 $MN/m^2$ using a profiled punch, and about 25 parts by weight additional electrolytic silver powder relative to the powder mixture are then laid over it. Now the two layers are compacted at a pressure of 450 $MN/m^2$ approx. to form a part having firm edges and the shape of the contact member to be produced, and heated for 15 minutes at a temperature of about 1100° C. in a hydrogen atmosphere. The amount of impregnating silver is dosed so that, when heated, the pores of the pressed part are almost completely filled with liquid silver and the surface is covered with silver to the extend that the depressions of the pressed profile are partly filled with silver. This creates a soldering surface which can be joined to a carrier material by brazing or by one of the conventional welding techniques. The finish molded part has a residual porosity of about 3 percent by volume and a carbon content of about 6.7 percent by weight, about half of it being present in the form of graphite, the other half in the form of tungsten carbide.

EXAMPLE 2

A powder mixture consisting of 76.8 percent by weight reduction tungsten powder (grain size smaller than 0.04 mm), 10 percent by weight electrolytic silver powder (grain size smaller than 0.037), 10 percent by weight electrolytic copper powder (grain size smaller than 0.063), 1.2 percent by weight carbonyl nickel powder (grain size 0.01 mm) and 2 percent by weight graphite (grain size smaller than 0.1 mm) is mixed intimately and granulated thermically by first producing plates under a pressure of 100 $MN/m^2$, sintering them for 30 minutes at about 950° C. in a hydrogen atmosphere and subsequently crushing them into granules of a particle size smaller than 0.315 mm. Another 2 percent by weight graphite are admixed to the granules. Under a pressure of 200 $MN/m^2$ a pressed part is made, under which a pressed electrolytic silver powder part is placed for impregnation. Again, the amount of impregnating silver is dosed so as to be sufficient to fill the pores completely and for a small excess to collect in the pressed profile, sufficient to form a solderable surface for connection. The impregnation itself takes place for 30 minutes in a hydrogen atmosphere at 1200° C.

EXAMPLE 3

A powder mixture consisting of 76.8 percent by weight reduction tungsten powder (grain size smaller than 0.063 mm), 20 percent by weight electrolytic copper powder (grain size smaller than 0.063 mm), 1.2 percent by weight carbonyl nickel powder (grain size smaller than 0.01 mm) and 2 percent by weight graphite (grain size smaller than 0.01 mm) is mixed intimately to distribute the ingredients uniformly and granulated thermically by producing plates at a pressure of 100 $MN/m^2$, sintering them for 30 minutes at about 950° C. in a hydrogen atmosphere and subsequently crushing them into granules of a particle size smaller than 0.315 mm. Another 3 percent by weight graphite are admixed to the granules. Compaction to a molded part takes place in a molding press at a pressure of about 200 $MN/m^2$. Placed under the skeleton thus produced is a pressed electrolytic copper powder part sufficient to fill the pores completely. The impregnation takes place at 1200° C. for 30 minutes in a hydrogen atmosphere.

EXAMPLE 4

Starting from a powder mixture consisting of 74.6 percent by weight reduction tungsten powder, 20 percent by weight electrolytic copper powder, 4 percent by weight graphite, and 1.4 percent by weight carbonyl nickel powder, granules are produced, to which another 6 percent by weight graphite is added. The pressure applied to produce the granules and the molded part is 150 $MN/m^2$, the grain sizes, sintering temperatures and other production data correspond to those of Example 1. The finished molded part is of the composition WCu46C6.74Ni0.8, the polished section showing that about half of the carbon is present in the form of free graphite.

EXAMPLE 5

Granules of the composition WAg10Cu10C2Ni1.2 are produced in accordace with the data of Example 2 and processed into a molded part with 1 percent by weight graphite. The ultimate composition of the molded part is WAg30Cu7.8Ni0.9C2.3.

The molded parts produced in accordance with these Examples were assembled as contact members in a test switch. Graphiteless impregnated materials whose metallic ingredients had the same composition were used for comparison. It turns out that, while burning is the same or slightly greater than in the comparison material, the fusing force is less by at least the factor 4 with the contacts of the present invention.

What is claimed is:

1. In impregnated sintered material for electrical contact members, comprising a silver and/or copper impregnated skeleton of tungsten, silver and/or copper, and an additive of a wetting promoting metal such as iron, nickel, cobalt, the improvement comprising the material having a carbon content from 2.0 to 7.0 percent by weight, present partly in bound form as tungsten carbide and partly in free form as graphite particles embedded in silver, with the ratio of bound to free carbon at least 1:5 and at most 5:1.

2. In a method for the production of an impregnated sintered material for electrical contact members, comprising a silver and/or copper impregnated skeleton of tungsten, silver and/or copper, and an additive of a wetting promoting metal such as iron, nickel, cobalt, comprising compacting a powder mixture containing tungsten, silver and/or copper, and a wetting promoting metal into a skeleton and subsequently sintering the skeleton and impregnating the skeleton with silver and/or copper, the improvement comprising admixing 2 to 5 percent by weight of graphite to the powder mixture; granulating thermically the mixture obtained in a protective gas atmosphere at temperatures between 800° and 1100° C.; and admixing another 1 to 6 percent by weight of graphite powder relative to the powder mixture to the granules prior to the compaction.

3. The improvement according to claim 2, wherein the total silver and/or copper content of the powder mixture is 10 to 45 percent by weight.

* * * * *